US005197689A

United States Patent [19]

Barone

[11] Patent Number: 5,197,689

[45] Date of Patent: Mar. 30, 1993

[54] SPOOL FOR WINDING FILIFORM ELEMENTS AND THE LIKE

[75] Inventor: Mario Barone, Buenos Aires, Argentina

[73] Assignee: Conarco Alambres y Soldaduras Sociedad Anonima, Provincia de Buenos Aires, Argentina

[21] Appl. No.: 784,774

[22] Filed: Oct. 30, 1991

[30] Foreign Application Priority Data

Mar. 22, 1991 [AR] Argentina ..... 319295

[51] Int. Cl.[5] ..... B65H 75/20; B65H 75/30

[52] U.S. Cl. ..... 242/118.7; 242/77.2

[58] Field of Search ..... 242/118.7, 118.4, 77.2, 242/129

[56] References Cited

U.S. PATENT DOCUMENTS 4,032,078 6/1977 Van de Loock ..... 242/77.2

FOREIGN PATENT DOCUMENTS 726704 3/1955 United Kingdom ..... 242/77.2

2037945 7/1980 United Kingdom ..... 242/77.2

*Primary Examiner*—Stanley N. Gilreath

*Attorney, Agent, or Firm*—Dickinson, Wright, Moon, Van Dusen & Freeman

[57] ABSTRACT

A spool for winding filiform elements and the like, comprised by two parallel rings joined by means of a plurality of U-shaped braces, including diametrally opposed accessory elements fixed at least to some of said braces and which, in turn, support a central nucleus allowing rotation of the spool.

4 Claims, 3 Drawing Sheets

SPOOL FOR WINDING FILIFORM ELEMENTS AND THE LIKE

FIELD OF THE INVENTION

The instant invention relates to a spool for winding filiform elements and the like, such as wires, cables, fibers, strips and, in general, any element capable of being wound.

BACKGROUND OF THE INVENTION—PRIOR ART

A plurality of spools are known to the above ends, each of which is more or less suitable for the filiform element to be wound thereon.

As a particular example, the case of spools for the step-wise partial delivery of the filiform element wound thereabout are cited. This is the case, among others, of wires used for welding.

This kind of spool is generally comprised by two parallel rings joined by means of U-shaped abutments having flat bottoms and located equidistantly in the circumferences determined by said ring.

The above described structure is widely used due to its simplicity, but has certain disadvantages which the instant invention to solve. In the first place, the structure of the prior art is weak for continuous and rough use, particularly when unloading and re-loading the spool. Also, these operations are cumbersome and time-consuming since the spool has no support allowing it to be placed on a winding machine or on a dispensing support.

SUMMARY OF THE INVENTION

The above and other disadvantages are overcome with the spool of the invention which comprises, as conventional spools do, two parallel rings joined by flat-bottomed U-shaped braces, which is characterized by having diametrally opposed accessory elements mounted on said braces which support a central driving nucleus.

Thus, said accessory elements improve, on one hand, the structural rigidity of the spool, since said central nucleus allows for the mechanical winding of filiform elements about the spool and, subsequently it permits the mounting of the spool on a dispensing support.

In accordance with a preferred embodiment of the invention, said supporting elements of the central nucleus are also shaped with a flat-bottomed U-contour connected, by its end portions, to the arms of said diametrally opposed braces.

In turn, the flat bottom of said elements is housed into corresponding longitudinal grooves at the nucleus periphery, which is made preferably of synthetic resin, the shape of which being substantially hollow and cylindrical.

In accordance with a most preferred embodiment of the invention, said nucleus is transversely divided into two equal portions such that, once the supporting elements are mounted, the corresponding longitudinal grooves at the periphery of said portions may be made to slide from both sides of the spool along the flat bottom of the supporting elements until they abut. It is obvious that this alternative greatly facilitates the construction of the assembly.

BRIEF DESCRIPTION OF THE DRAWINGS

In all figures the same reference numerals indicate the same or corresponding parts.

DETAILED DESCRIPTION OF THE INVENTION

The spool is comprised by parallel rings 1 and 2 supported by a plurality of equidistant braces 3 as per an even number of units, such that each brace corresponds to a diametrally opposed counterpart.

At certain pairs of opposed braces 3 corresponding flat-bottomed U-shaped elements 4 are mounted, such that the ends of their arms are fixed to the arms of the corresponding brace 3 and their opposite flat bottoms are spaced apart a determined distance.

Figure 1:
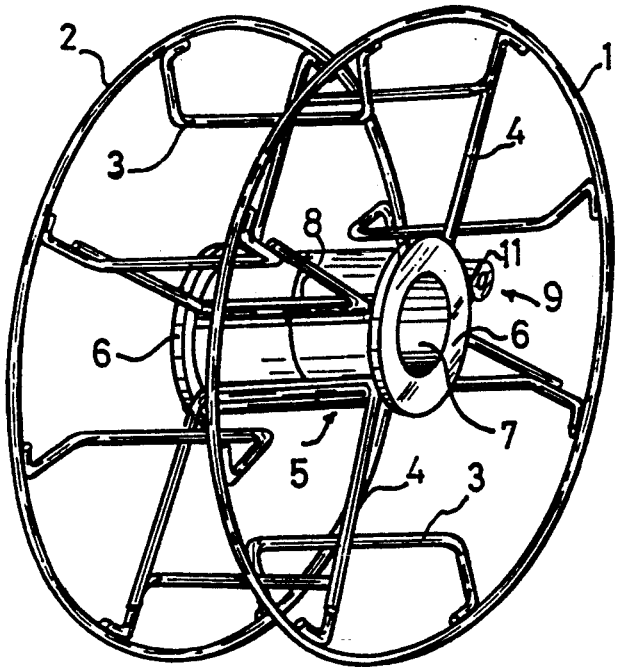
FIG. 1 is a perspective view of the spool.
Figure 2:
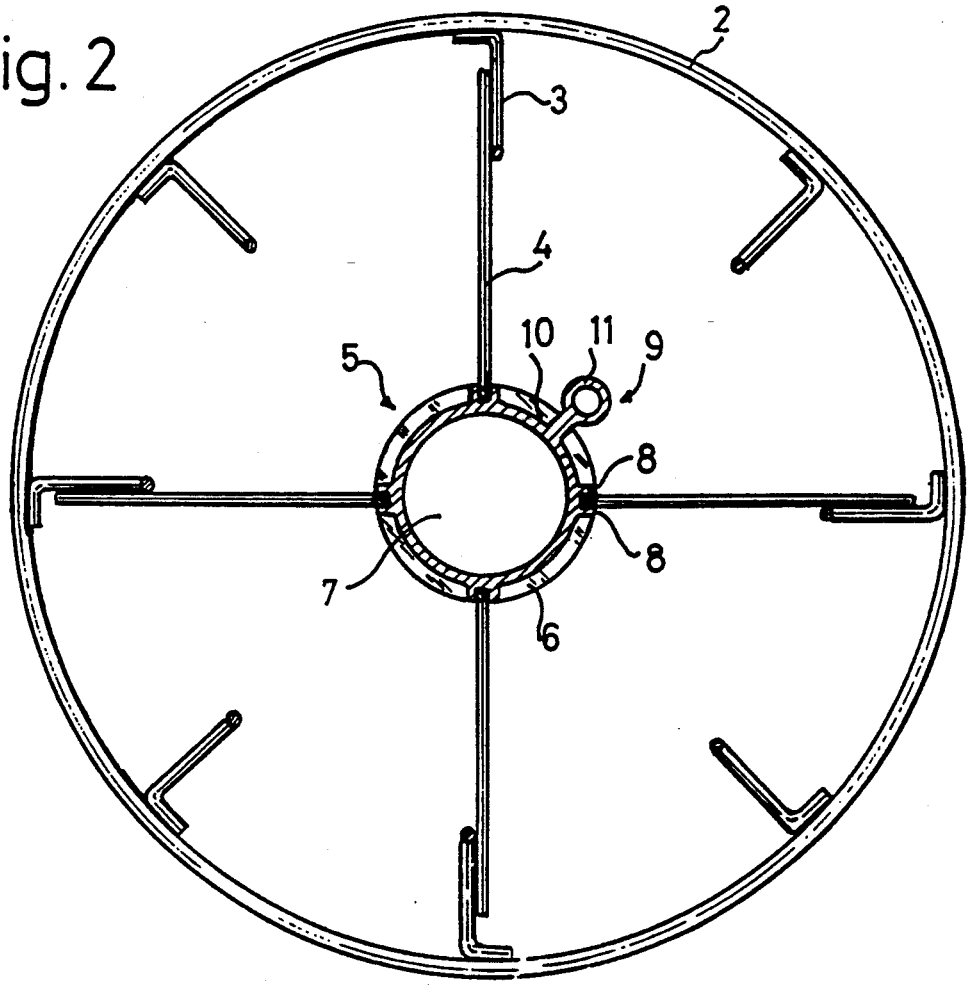
FIG. 2 is an elevational section thereof.
Figure 3:
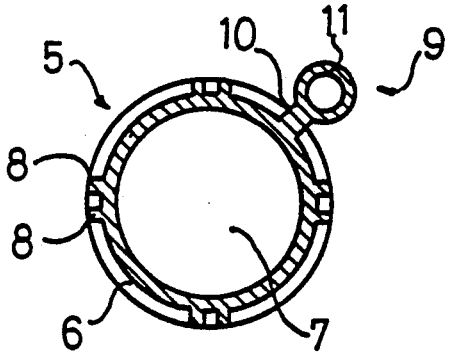
FIG. 3 is a cross section of the nucleus.

The central space between said flat bottoms is occupied by a substantially cylindrical nucleus 5 which, as may be seen in FIGS. 1 to 3, has at its ends corresponding peripheral flanges 6 and an axial hole 7. The body of the cylindrical nucleus 5 has a plurality of diametrally opposed grooves determined by corresponding longitudinal ribs 8 provided in pairs and spaced apart a distance equal to the thickness of elements 4 and into which the flat bottoms thereof are housed.

Further, nucleus 5 has an external longitudinal shoulder 9 formed by a longitudinal projection 10, the edge of which is shaped as a hollow cylinder 11, which radially extends over flanges 6 of the nucleus. This projection is precisely the element for engaging a drive means (not shown) and allowing the spool to be driven in suitable machines for winding or unwinding filiform elements.

Figure 4:
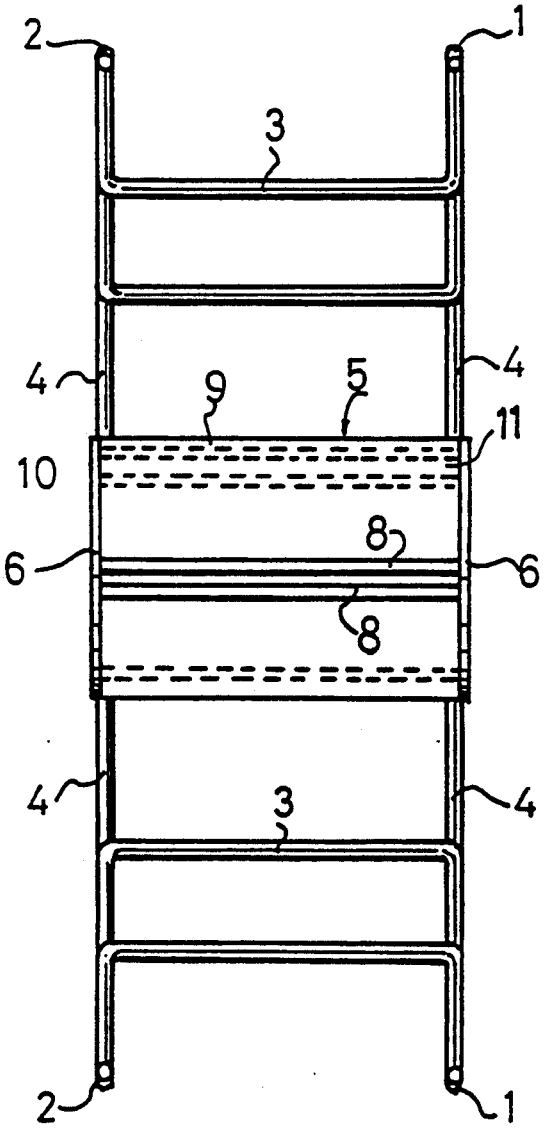
FIG. 4 is a partial elevational section of the spool assembled.
Figure 5:
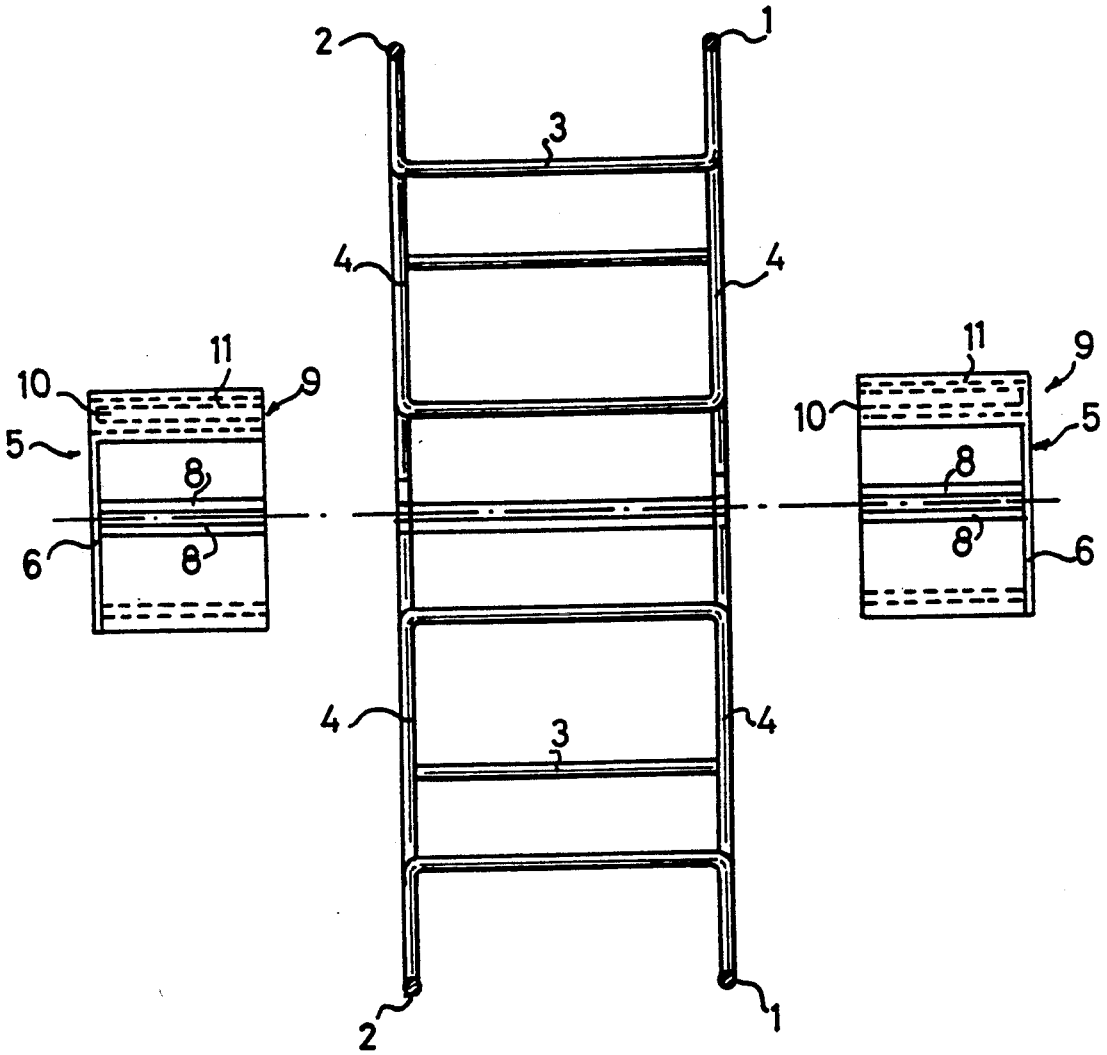
FIG. 5 is an exploded elevational section of the spool.

In accordance with the embodiment disclosed, nucleus 5 is transverselly divided in two equal portions, as may be seen in FIGS. 1, 4 and 5. In FIG. 5 the nucleus is shown before being mounted on the spool. The mounting is carried out by sliding the flat bottoms of elements 4 along the grooves determined by ribs 8 until, due to the size of the nucleus, flanges 6 contact the arms of elements 4, while both portions of the nucleus abut.

When the nucleus 5 is formed as a unit, the mounting procedure will be such that the bases of elements 4 are seated on the grooves determined by ribs 8 and then the ends of the arms of said elements 4 are fixed to braces 3 by means, for example, of welding or a similar resource.

I claim:

1. Apparatus for winding filiform elements comprising a spool and a central element for mounting the spool on a winding support, wherein said spool comprises first and second generally parallel rings spaced in a longitudinal direction, a plurality of brace means for receiving said filiform elements, each of said brace means extending between said first and second rings, and a plurality of accessory means secured to selected ones of said brace means for connecting said first and second rings to said central element and having substantially linear, flat bottom segments, wherein said central element is generally cylindrical and includes an outer surface with grooves extending longitudinally along the length of said central element, each of said grooves receiving a respective one of said linear, flat bottom segments, and wherein said central element further comprises first and second flange means at respective opposite ends thereof for preventing longitudinal movement of said bottom segments in said grooves, each of said flange means comprising a peripheral annulus extending radially outward from said central element for engaging respective ends of said bottom segments.

2. Apparatus according to claim 1 wherein said central element is transversely divided into first and second parts.

3. Apparatus according to claim 1 wherein said central element further comprises means for engaging means for driving said spool for winding or unwinding said filiform elements.

4. Apparatus according to claim 3 wherein said means for engaging comprises a projection extending radially outward from said outer surface.

* * * * *